US006375797B1

(12) United States Patent
Henricson et al.

(10) Patent No.: US 6,375,797 B1
(45) Date of Patent: Apr. 23, 2002

(54) BLEACHING CHEMICAL PULP IN A PKDQ-PO SEQUENCE

(75) Inventors: Kaj Henricson, Helsinki; Olavi Pikka, Karhula, both of (FI)

(73) Assignee: Andritz-Ahlstrom Oy, Helsinki (FI)

( * ) Notice: Subject to any disclaimer, the term of this patent is extended or adjusted under 35 U.S.C. 154(b) by 0 days.

(21) Appl. No.: 09/083,216

(22) Filed: May 22, 1998

Related U.S. Application Data

(63) Continuation-in-part of application No. 08/670,206, filed on Jun. 20, 1996, now abandoned.

(51) Int. Cl.[7] ..... D21C 9/14; D21C 9/147; D21C 9/153; D21C 9/16

(52) U.S. Cl. ..... 162/65; 162/76; 162/78; 162/88; 162/89

(58) Field of Search ..... 162/76, 78, 88, 162/89, 65

(56) References Cited

U.S. PATENT DOCUMENTS 5,143,580 A * 9/1992 Basta et al. ..... 162/78

FOREIGN PATENT DOCUMENTS

| | | | | |
|---|---|---|---|---|
| CA | 946 107 | * | 4/1974 | |
| WO | 79/00861 | * | 11/1979 | ..... 162/78 |
| WO | 95/27100 | * | 10/1995 | ..... 162/76 |
| WO | 96/06976 | * | 3/1996 | ..... 162/76 |

* cited by examiner

*Primary Examiner*—Steve Alvo
(74) *Attorney, Agent, or Firm*—Nixon & Vanderhye P.C.

(57) ABSTRACT

In a method and apparatus for treating pulp, a peroxide treatment of chemical pulp, i.e., both sulphite pulp and kraft pulp, is used to quickly reduce the Kappa number of the pulp. The method involves treating a chemical pulp with at least hydrogen peroxide or its equivalent, the kappa number of which chemical pulp has been brought to a level below 20 by either at least cooking or cooking and delignifying. The pulp is treated in a fast alkaline or neutral peroxide stage (Pk) (e.g. a small reactor having a volume of, or proportional to, less than about 90 cubic meters for 1500 tons per day pulp treatment) to reduce the kappa number by 1–10 units, and preferably by 3–7 kappa units, in which treatment the reaction time is less than 10 minutes, and is preferably less than 5 minutes. The pulp is then transferred substantially without intermediate washing of any type to a bleaching tower, and then bleached further in an acidic bleaching step (e.g. a D or Z step) in the bleaching tower.

13 Claims, 2 Drawing Sheets

BLEACHING CHEMICAL PULP IN A PKDQ-PO SEQUENCE

This application is a continuation-in-part of application Ser. No. 08/670,206 filed Jun. 20, 1996, and now abandoned.

BACKGROUND AND SUMMARY OF THE INVENTION

The present invention relates to a method for treating pulp. In particular, the invention relates to a combined peroxide and acidic treatment of chemical pulp, i.e., both sulphite and kraft (sulphate) pulp, in two separate steps substantially without intermediate washing of any type (including no thickening and no pressing) between the steps, and to a method for effecting such a treatment in a novel and efficient manner.

Peroxide bleaching is conventionally effected at relatively-high temperatures, and requires long bleaching times, e.g., 1 to 7 hours. Normally, the treatment takes 2 to 4 hours since the brightness of the pulp increases slowly during conventional alkaline peroxide bleaching processes, as is shown in FIG. 1. The bleaching process is conducted using peroxide stages. Usually, the peroxide stages needed for bleaching are alkaline. Acidic peroxide stages (having a pH under 5, and preferably under 3) behave in a different manner than alkaline stages. An acidic stage is fast, and usually requires only about 15 minutes for delignification. According to prior art, an acidic peroxide stage is fast and an alkaline peroxide stage is slow (usually taking more than an hour). Surprisingly, it has been found that alkaline peroxide stages having a pH of 9 to 12, preferably 10 to 11 function so that delignification takes place rapidly and bleaching slowly. A peroxide stage effected in neutral conditions (having a pH of 5 to 9) is also fast.

Recent delignification and bleaching trials have now surprisingly revealed that during an alkaline peroxide treatment, the kappa number reduces quickly—in a matter of a few minutes. An alkaline treatment time of less than 10 minutes, even less than 5 minutes, has been found to be sufficient for reducing the kappa number. FIG. 2 indicates the reduction of the kappa number during time in a peroxide treatment. When a peroxide treatment is employed to reduce the kappa number, and an increase in brightness is not significant or required, then a quick peroxide stage should be sufficient to reduce the kappa number.

Throughout the specification and claims, the following symbols are used for various treatment stages:

"Q"=heavy metal removal using chelating agents, such as EDTA or DTPA;

"A"=heavy metal removal by acid treatment;

"–"=a conventional washing or pressing;

"="—a fractionating wash (e.g., an efficient wash using a DRUM DISPLACER® washer (A. Ahistrom Corporation));

"O"—oxygen treatment;

"$O_p$"=oxygen treatment with peroxide addition (e.g., 1–10 Kg $H_2O_2$/ton pulp);

"Z"=ozone bleaching;

"P"=alkaline peroxide bleaching;

"Pk"=fast alkaline peroxide bleaching;

"$P_o$"=peroxide bleaching with oxygen addition (e.g., 1–10 Kg $O_2$/ton pulp);

"D"=chlorine dioxide treatment;

"I"=either or both of the steps on either side thereof; and where two or more steps are listed right next to each other, there is substantially no intervening washing of any type (e.g. no displacement washing, no thickening).

According to one aspect of the present invention a method of treating chemical pulp with at least hydrogen peroxide or the equivalent, is provided, wherein the kappa number of the chemical pulp has been brought to a level below 20 by cooking, or cooking and delignification, or the like. The method comprises the steps of: (a) treating the pulp in a fast alkaline, neutral, or acidic peroxide step (Pk) to reduce the kappa number by 1–10 kappa units and in which step the reaction time is less than 10 minutes, (b) transferring the pulp, substantially without intermediate washing of any type, to a bleaching tower, and (c) bleaching the pulp further in an acidic bleaching step in the bleaching tower. During step (b) acidic bleaching chemical may be mixed with the pulp, and step (c) may be practiced using chlorine dioxide or ozone as the acidic bleaching chemical.

The method may also comprise the further step (d) of treating the pulp with chlorine dioxide after the practice of steps (a) through (c). Further in step (c) the pulp may be treated in the Pk and ozone stages to decrease consumption of chlorine dioxide in step (d).

Steps (a) through (c) may be practiced in accordance with the following partial treatment sequence: A-PkDQ-Po, in which Pk is either Pk alone, PkO, or PkOp and in which the A stage is replaceable with a Q or D stage. The sequence may be preceded by an oxygen delignification stage. Ideal conditions in step (a), especially for kraft pulp, are alkaline pH, 78–110° C., about 8–20% pulp consistency, and a time of less than about 5 minutes, and a kappa number reduction of 3–7 units.

Alternatively, steps (a) through (c) may be practiced utilizing the following partial treatment sequence: A-PkD-Po, and A-PkD, in which Pk is either Pk alone, PkO, or PkOp and in which the A stage is replaceable with a Q or D stage. There may also be the further step, before step (a), of oxygen delignifying the pulp in at least one oxygen delignification stage. At least one of the D stages may be supplied with Mg and/or Ca to adjust the metal profile to a desired value.

According to another aspect of the present invention steps (a) through (c) may be practiced utilizing the following partial treatment sequence: A-PkD-E-D; A-PkZDN-D' and A-PkZ-D; which Pk is either Pk treatment alone, or PkO, or PkOp and in which the A stage is replaceable with a Q stage, i.e., chelation or with a D stage; or steps (a) through (c) may be practiced with the following other partial treatment sequences:

O-A-PkD-E-D; O-A-PkZDN-D; and O-A-PkZ-D; in which Pk is, besides Pk alone, also treatment PkO, or PkOp, and wherein the A stage is replaceable with a Q stage, i.e., chelation or with a D stage;

A-PkAZQ-Po; and A-PkZQ-Po; wherein Pk is, besides Pk alone, also treatment PkO, or PkOp and in which the A stage is replaceable with a Q stage, i.e., chelation, or with a D stage;

A-PKAZ-Po; and A-PkZ-Po; wherein Pk is, besides Pk alone, also treatment PkO, or PkOp, and in which the A stage is replaceable with a Q stage, i.e., chelation, or with a D stage; or O-A-Pk-ZQ-Po; and O-A-PkZQ-Po; wherein Pk is, besides Pk alone, also treatment PkO, or PkOp and in which the A stage is replaceable with a Q stage, i.e., chelation, or with a D stage.

In any of the above sequences the A stage of the treatment sequence may be a DQ or a D stage which is supplied with chemicals adjusting the metal profile, selected from the group consisting essentially of Mg, Ca, DTPA, EDTA, NTA, and HEDTA.

The method steps of the invention may be practiced with kraft (sulphate) pulp, or with sulphite pulp. When practiced with sulphite pulp metal removal prior to the Pk stage is not necessary, or utilized.

According to another aspect of the present invention there is provided: A first small (i.e. a maximum volume of 90 $m^3$ for 1500 tons per day pulp production, preferably about 45 $m^3$ or even less) reactor in which pulp having a kappa number below 20 is treated in a fast alkaline, neutral, or acidic peroxide step (Pk) to reduce the kappa number by one to ten kappa units, and in which the reaction time is less than ten minutes. A second reactor comprising a bleaching tower. A conduit connecting the first reactor to the second reactor, the conduit including substantially no intermediate washing device of any type. And apparatus which effects acidic bleaching in the second reactor. A mixer for mixing acidic bleaching chemical with the pulp may be provided in the conduit between the reactors (e.g. bleaching towers), as part of the apparatus which effects acidic bleaching (along with conventional feeds, withdrawals, and outlets of and for the second reactor).

It is the primary object of the present invention to provide effective treatment of chemical pulp including one which is very favorable in terms of overall economy of treatment. This and other objects of the invention will become clear from an inspection of the detailed description of the invention, and from the appended claims.

DETAILED DESCRIPTION OF THE DRAWINGS

In a first trial, pulp was treated with hydrogen peroxide, the kappa number of the initial pulp being 9 and the brightness 50. The bleaching conditions were as follows:

$H_2O_2$ dosage of 3.5%, corresponding to a dosage of 35 kg/adt.

NaOH dosage of 1.5 to 2.5%.

$MgSO_4$ dosage of 0.5%.

Temperature was 90° C.

Pressure was atmospheric pressure.

pH alkaline, in the range of 9 to 12.

Consistency ranging from 8 to 20%.

Figure 1:
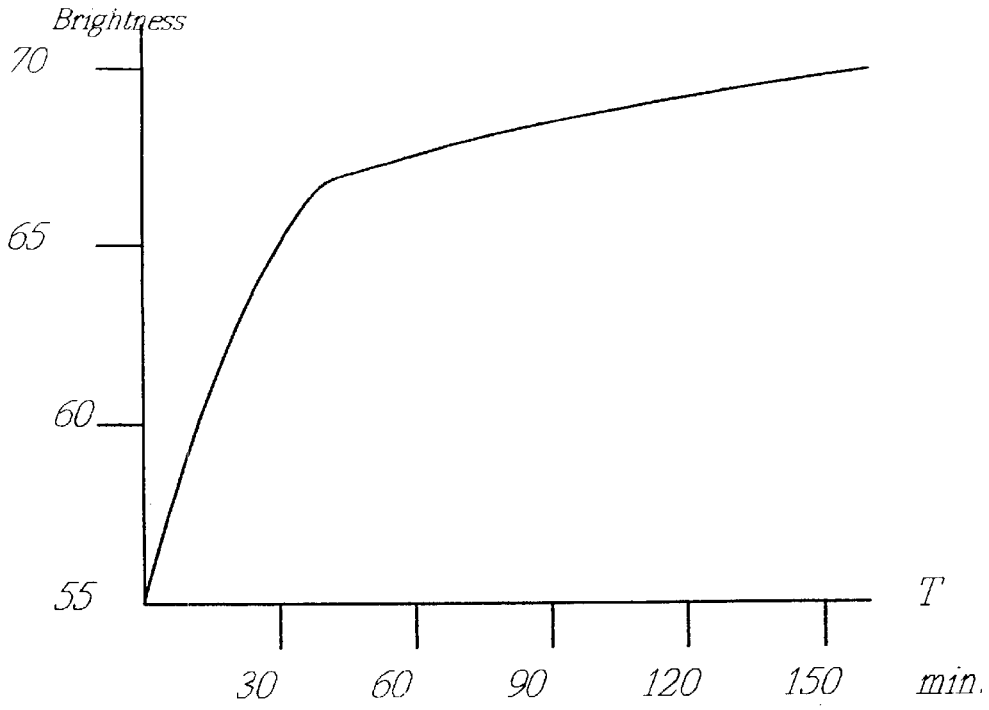
FIG. 1 illustrates the change in brightness as a function of treatment time when pulp is bleached with peroxide.
Figure 2:
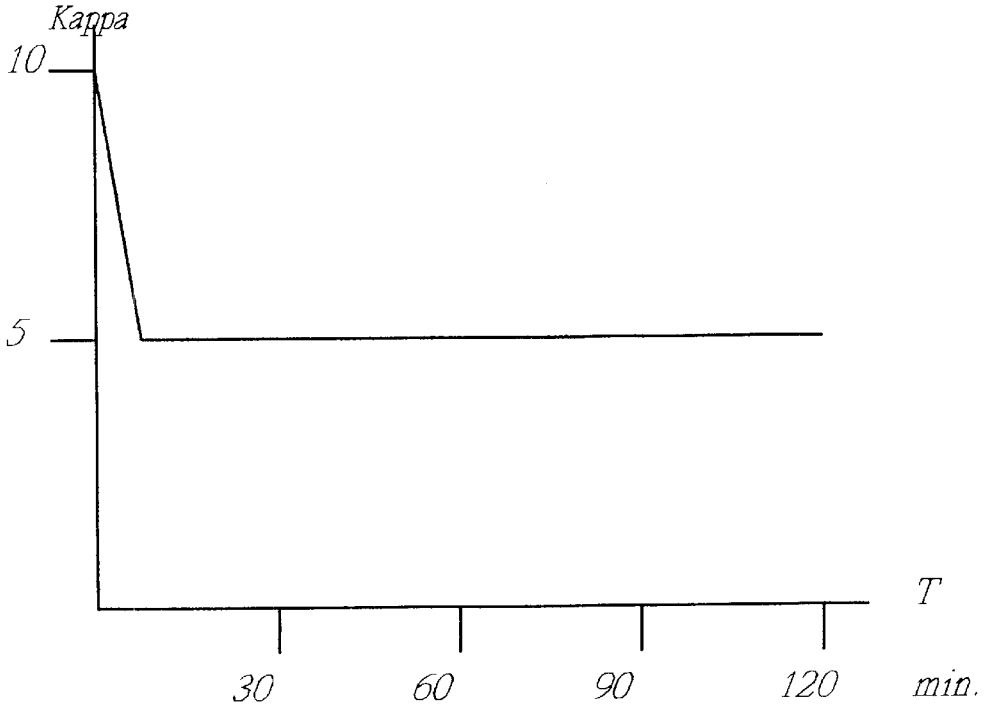
FIG. 2 illustrates reduction of the kappa number as a function of time during delignification with peroxide.

FIG. 1 indicates the change of brightness as a function of time and FIG. 2 the change of kappa number as a function of time. After five minutes from starting the trial, 3 to 7 kg of peroxide/pulp ton had been consumed and the kappa number had been reduced by 5 units.

The test was repeated in a second trial with a peroxide dosage of 5 kg $H_2O_2$/pulp ton, and this small dosage also reduced the kappa number by 5 units in a treatment time of 2 minutes. A shorter treatment time could not be tested because of the arrangements in the laboratory for the trial. Based on the trials, it was established that the kappa number could be reduced by 5 kappa units with a dosage of 5 kg $H_2O_2$/adt in a treatment time of even less than 2 minutes. The treatment took place under alkaline conditions at a pH of 9 to 12, and it was found that an advantageous pH range was 10 to 11.

The bleaching effect of peroxide, which was also studied in this connection, was established to be in compliance with prior art, i.e., even several hours were required for bleaching. In addition, it is possible that the treatment may be done in a neutral pH range, i.e., 5 to 9.

The tests also revealed that prior to a fast peroxide stage (Pk) in accordance with our invention, it is advantageous to treat the pulp with an A (acid) or Q (chelation) stage for improving the bleachability and/or for adjusting the metal profile. Magnesium (Mg) and Calcium (Ca) may be added in a conventional manner. The Q stages are more completely disclosed in the prior art, e.g., in Eka Nobel's patent applications such as published European Patent Applications 0 511695 A1 and 0 512 590 A1. The A-stage may be hot and thereby delignifying as discussed in EP.

Based on the trials, the peroxide stage Pk may be either pressurized or at substantially atmospheric pressure. The peroxide stage Pk may also be acidic (pH under 5 ), neutral (pH in the range of 5 to 9) or alkaline (pH in the range of 9 to 12). The peroxide dosage is preferably 1 to 10 kg/adt, typically 3 to 7 kg/adt. The process may be a low pulp consistency, medium pulp consistency, or high pulp consistency process, e.g., the consistency may range from 1 to 40%. The peroxide stage Pk may also be effected at a temperature required by the rest of the process, usually in the range of 50° C. to 130° C., preferably about 80° C. to 110° C. For example, Mg, Ca, EDTA, DTPA, oxygen, alkali, or other chemicals may be used as additional chemicals at the Pk stage for bleaching, delignification, metals removal, or metal profile adjustment.

On the basis of the tests performed, an advantageous duration for a fast peroxide treatment Pk is 0 to 10 minutes, and preferably 0 to 5 minutes, e.g. 30 seconds to 5 minutes, or 30 seconds to 10 minutes. A suitable reaction time depends on how the fast peroxide stage Pk is connected with the process. Because the reactor (16 in FIG. 3) is small, its cost is insignificant.

Figure 3:
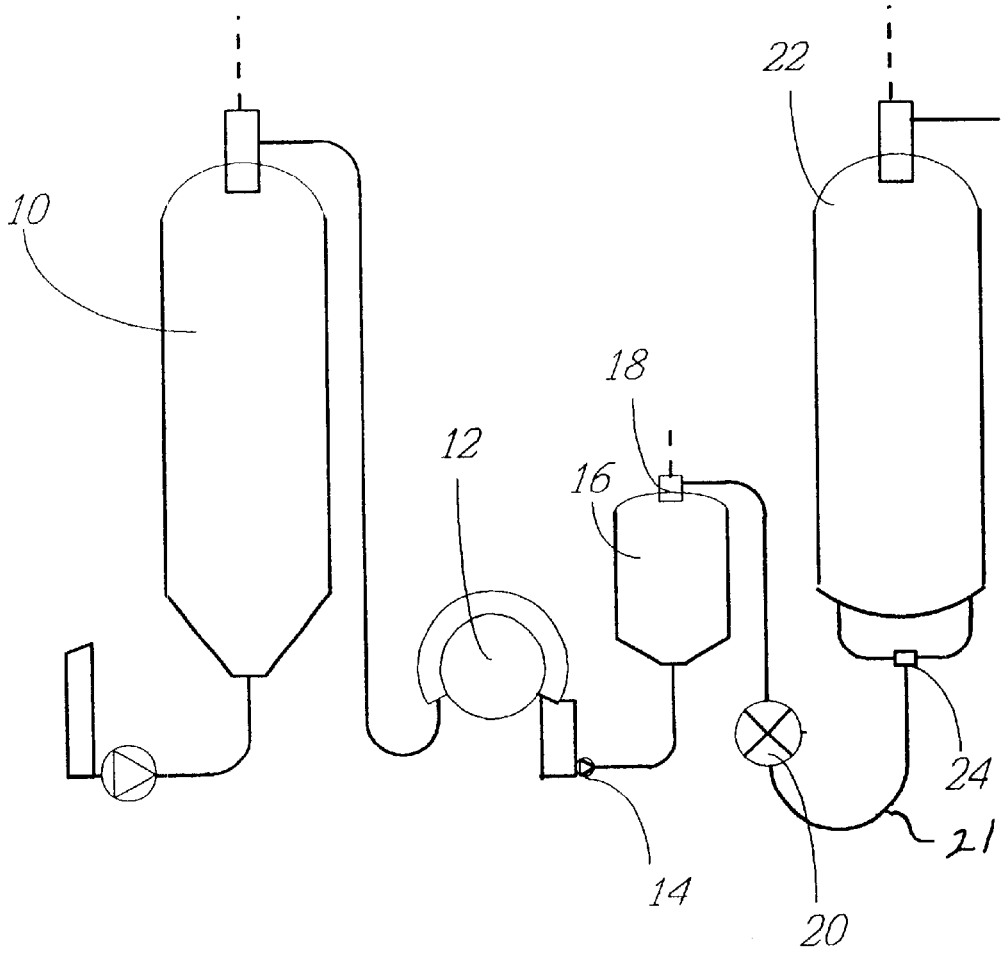
FIG. 3 is a schematic illustration of a combined peroxide and acidic treatment according to the present invention

A pulp treatment process in accordance with a preferred embodiment of the invention is shown in FIG. 3. In this process, pulp is treated in a tower 10 (preferably in an acidic stage, though alkaline metal removal with complexing agents will also do) and then washed in a washer 12 so that, after washing, the kappa number of the pulp is below 20, e.g. in the range of 5 to 15. From washer 12, pulp is pumped with a pump 14, preferably an A. AHLSTROM CORPORATION MC® pump, to a small peroxide reactor 16. The chemical or chemicals needed in the peroxide treatment are preferably added to the pulp in pump 14, but a separate mixer may also be used to add chemicals. In the reactor 16, pulp is delignified in a fast peroxide step (Pk) so that the kappa number is reduced by 2–7 kappa units, preferably under alkaline conditions. In this fast peroxide step (in 16), the reaction time is less than 10 minutes, preferably less than 5 minutes, the temperature preferably is 70° C. to 110° C., and the pulp preferably has a consistency of 8 to 20%. After the peroxide step, the pulp is discharged from reactor 16 to a second bleaching reactor 22. The pulp discharged from reactor 16 is preferably conveyed by the pressure of pump 14 in a conduit 21 to a mixer 20, in which a chemical/chemicals for the next treatment step are mixed with the pulp. Preferably, but not necessarily, pulp is conveyed via a distributing bottom feed means 24 to the treatment tower/reactor 22. Preferably, but not necessarily, gas is separated from the pulp either at the outlet of peroxide reactor 16, at the distributing bottom feed means 24, or conventional separate gas separation means prior to tower 22. Where the gas should be separated from the pulp depends on whether gaseous treatment chemicals are used in tower 22 and at which stage they are added to the pulp. Further, in connection with FIG. 3, the reactor 16 need not be an actual vessel, but may be an elongated conduit, or a set of parallel conduits, since the peroxide treatment in accordance with the present invention requires a reaction time of only, at most, a few minutes.

In mixer 20, chlorine dioxide, or ozone, or other acidic bleaching chemicals, any of these either alone or together with some other chemical, either mentioned or unmentioned hereinabove, are preferably mixed with pulp for a treatment stage such as PkD, PkZ, PkZD, or some other combination of steps. Combinations of three or more steps may also be considered, such as for example, PkDQ, PkZQ, PkAZQ, PkZDQ, or PKAZDQ. Some treatment may also precede the fast Pk step. Such a treatment may be, e.g. an enzyme treatment En, so that the stage may be EnPk. In other words, the fast peroxide treatment (Pk) step according to the invention may be combined with at least one of the following steps: ozone treatment (Z), acid treatment (A), and/or chlorine dioxide treatment (D), for bringing about one or more treatment stages, in which the order of treatments may be changed to another order than the one given hereinabove, in order to reach a desired result. Steps Q, O, Op, Po, D, and Z have been described, e.g., in A. AHLSTROM CORPORATION's Finnish patent applications 953064, 951196, 950749, and 944348 and in Swedish patent application 9502087, all of which are incorporated by reference herein.

There is substantially no washing of any type (e.g. no displacement washing with pressurized or vacuum washers, pressing, or thickening) between the reactors 16, 22.

The process shown in FIG. 3 should not be confused with a conventional peroxide bleaching stage and its inlet piping. In the conventional stage, a long bleaching time is sought, and the bleaching takes place in a large reactor. Tower 22 in FIG. 3 corresponds to such a reactor, but in the invention, the tower 22 is not used for the peroxide treatment of the invention. Rather, the tower 22 is used for a totally different treatment. In the present invention, the kappa number is reduced with peroxide prior to feeding the chemical to be used in reactor 22 to mixer 20. This chemical is an acidic bleaching chemical. It is advantageous that the peroxide from the fast stage ($P_k$, in reactor 16) be completely or almost completely consumed prior to adding another chemical in mixer 20.

The combined stage, Pk+acidic steps, may be arranged in an arbitrary place in a bleaching sequence. Some interesting sequences containing chlorine dioxide are:

O-A-PkDQ-Po, in which Pk may be PkO (i.e. a step where oxygen is introduced to enhance the bleaching effect), or Q may be deleted, particularly, if the following stage is used:

O-A-PkD-Po, in which the D stage may be further supplied with Mg and/or Ca in order to adjust the metal profile. The D step may also be supplied with EDTA, DTPA, or some other chelating agent.

Other sequences which may be considered and which apply the fast peroxide step according to the invention are:

O-A-PkD-E-D,

O-A-PkZDN-D, and

O-A-PkZ-D, in which Pk may be replaced with either PkO, and in which the A stage may be replaced also with a Q stage, i.e., chelation, or with a D stage which is potentially supplemented with chelation or metal profile adjustment.

The method according to the invention is well applicable to, e.g., the following TCF sequences:

O-A-PkAZQ-Po, and

O-A-PkZQ-Po, in which Pk may be PkO, or Q may be deleted. Also in these sequences, the A stage may be replaced with a Q stage. The ZQ stage is often preceded with an A step, so ZQ may also be AZQ.

In the above-identified sequences the oxygen delignification (O) may be omitted if the kappa number after cooking is sufficiently low. The A stage may be omitted also when pulp does not need an A or Q treatment, i.e. metal removal prior to the Pk stage, e.g., when sulphite pulps are dealt with.

A still further embodiment of the invention are sequences which use, besides chlorine dioxide (D) also ozone (Z). The following sequences may be implemented with reactor and tower constructions similar, in principle, to those in the sequences described hereinabove; in other words, by connecting several reactors and towers one after another. The treatment may be effected, for example, as a partial sequence AQ-PkZ. It is possible to build heat exchangers in connection with the towers, in accordance with patent application FI 953064. In that case the treatment temperature is also easy to regulate to a desired level. A further interesting sequence is AQ-PkZ-ZP. An advantage of this sequence is an open AQ stage prior to the PkZ stage, which lessens concentration of solids from the oxygen (O) and Q stages to the first Z stage. Such concentration would increase the ozone consumption by 1–2 kg/BDMT.

Making up the sequence O-AZQ-ZPk-ZPo and providing the towers with indirect heat exchange, if necessary, would give us a variety of running alternatives. For example, the ozone dosage may be omitted from one or more ozone stages, thereby changing the sequence to another one.

In all above identified sequences, "Z" refers to an ozone stage, or step. The ozone step may be combined with an acid treatment (A) and/or chelation (Q). Thus "Z" may mean, for example, AZ, ZQ, or AZQ.

The chlorine dioxide step may be connected with metal profile adjustment in two ways. After the chlorine dioxide treatment, pulp is taken to a Q tower, where it is treated with a complexing agent (e.g, EDTA, DTPA, or equivalent) and potentially with metals (e.g., Mg, Ca). So, a DQ stage is received. Another possibility is to add to the D stage chemicals adjusting the metal profile, such chemicals being, e.g., Mg and Ca, possibly together with EDTA, DTPA, NTA, HEDTA, or some other complexing agent. The D stage thereby becomes a D stage provided with metal profile adjustment.

The reactor 16 whether as a vessel, long pipe, series of pipes, etc., is small by conventional standards for bleaching reactors. For example, the reactor 16 (regardless of its configuration, including whether it is merely a conduit per se) typically has a maximum volume of about 90 cubic meters, corresponding to a treatment time of about ten minutes for pulp treatment of 1500 tons per day, or proportional thereto for other treatment volumes, and preferably is (or is proportional to) about 45 cubic meters or even less. The reactor 22 may be of any size, e.g. it has a maximum volume of 1200 cubic meters for a treatment time of two hours for 1500 tons per day production, and preferably is about 900 cubic meters.

As can be seen from the above, a method which is new and favorable in terms of overall bleaching economy, has been developed for treating chemical pulp. Even though a large number of sequences and partial sequences have been described hereinabove, it has to be understood that corresponding other sequences used in the same manner and principle of operation, are also included in the scope of the invention, which scope is to be accorded the broadest interpretation of the appended claims so as to encompass all equivalent methods and apparatus.

What is claimed is:

1. A method of treating chemical pulp with at least one peroxide pulp-treating chemical, wherein the kappa number of the chemical pulp has been brought to a level below 20 by delignification, said method comprising the steps of: (a) treating the chemical pulp in a fast alkaline, neutral, or acidic peroxide step (Pk) to reduce the kappa number by 1–10 kappa units for a reaction time of less than 10 minutes, (b) transferring the pulp substantially without intermediate washing of any type, to a bleaching tower, and (c) bleaching the pulp further in an acidic bleaching step in the bleaching tower; wherein (a) and (c) are practiced at a temperature of between 50–130 degrees C, and wherein steps (a)–(c) are practiced in accordance with the following partial treatment sequence A-PkDQ-Po, in which Pk is either Pk alone, PkO, or PkOp, and in which the A stage is replaceable with a Q or D stage.

2. A method according to claim 1, further comprising, during step (b), mixing acidic bleaching chemical with the pulp.

3. A method according to claim 2, wherein steps (c) and (b) are practiced using chlorine dioxide as an acidic bleaching chemical.

4. A method according to claim 1, comprising the further step, before step (a), of oxygen delignifying the pulp in at least one oxygen delignification stage.

5. A method according to claim 1, wherein the A stage of the treatment sequence is a DQ or a D stage which is supplied with chemicals adjusting the metal profile, selected from the group consisting essentially of Mg, Ca, DTPA, EDTA, NTA, and HEDTA.

6. A method as recited in claim 1, wherein steps (a)–(c) are practiced using kraft pulp, and wherein step (a) is practiced under alkaline conditions at a temperature of 70–110° C. and at a pulp consistency of about 8–20%, for five minutes or less, and to reduce the kappa number 3–7 units.

7. A method as recited in claim 1 wherein (a) is practiced with a peroxide dosage of between 1–10 kg/adt.

8. A method as recited in claim 7 wherein (a) and (c) are practiced at a temperature of between 80–110 degrees C.

9. A method as recited in claim 8 wherein (a) is practiced for a time period of less than 5 minutes.

10. A method as recited in claim 8 wherein (a) is practiced with a peroxide dosage of between 3–7 kg/adt.

11. A method as recited in claim 10 wherein (a) is practiced at alkaline conditions for a time period of about 30 seconds to less than less than 5 minutes.

12. A method as recited in claim 1 wherein (a) is practiced at alkaline conditions for a time period of about 30 seconds-less than 5 minutes, and a temperature of between 80–110 degrees C.

13. A method as recited in claim 12 wherein (a)–(c) are practiced using kraft pulp at a consistency of about 8–20%.

* * * * *